US010777140B2

(12) United States Patent
Kim et al.

(10) Patent No.: US 10,777,140 B2
(45) Date of Patent: Sep. 15, 2020

(54) ORGANIC LIGHT EMITTING DISPLAY DEVICE AND DRIVING METHOD THEREOF

(71) Applicant: LG Display Co., Ltd., Seoul (KR)

(72) Inventors: Hyunwook Kim, Paju-si (KR); Hyuckjun Kim, Paju-si (KR); Kyungrok Kim, Paju-si (KR); Sanghoon Lee, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 16/422,388

(22) Filed: May 24, 2019

(65) Prior Publication Data

US 2019/0378459 A1 Dec. 12, 2019

(30) Foreign Application Priority Data

Jun. 12, 2018 (KR) ..... 10-2018-0067669

(51) Int. Cl.
*G09G 3/3233* (2016.01)
*G09G 3/3258* (2016.01)

(52) U.S. Cl.
CPC ..... *G09G 3/3258* (2013.01); *G09G 3/3233* (2013.01); *G09G 2300/043* (2013.01);
(Continued)

(58) Field of Classification Search
CPC .. G09G 3/2022; G09G 3/3225; G09G 3/3233; G09G 3/3258; G09G 3/3291; G09G 5/18; G09G 2300/043; G09G 2300/08; G09G 2300/0819; G09G 2310/0294; G09G 2310/063; G09G 2310/08; G09G 2320/02; G09G 2320/0204; G09G 2320/0233;
(Continued)

(56) References Cited

U.S. PATENT DOCUMENTS

2006/0066255 A1* 3/2006 Lee ..... G09G 3/3241 315/169.3
2007/0080905 A1* 4/2007 Takahara ..... G09G 3/3258 345/76
(Continued)

FOREIGN PATENT DOCUMENTS

EP 3 113 163 A1 1/2017

OTHER PUBLICATIONS

Intellectual Property Office of the United Kingdom, Search Report, GB Patent Application No. GB1908381.5, dated Dec. 9, 2019, four pages.

*Primary Examiner* — Michael J Eurice
(74) *Attorney, Agent, or Firm* — Fenwick & West LLP

(57) ABSTRACT

The organic light emitting display device according to the present disclosure comprises an input unit configured to receive image data input at a variable frame frequency, a sensing control unit configured to generate a sensing control signal for sensing pixels to which the image data is to be applied, in a vertical blank period varying according to the variable frame frequency and a TFT compensating unit configured to sense driving characteristics of a driving element included in the pixels according to the sensing control signal to output a first sensing result. Among one variable frame period, a vertical active period for applying the image data to the pixels is fixed and the vertical blank period in which no image data is applied to the pixels is varied according to the variable frame frequency.

22 Claims, 11 Drawing Sheets

(52) U.S. Cl.
CPC ... *G09G 2300/08* (2013.01); *G09G 2310/063* (2013.01); *G09G 2320/0204* (2013.01)

(58) Field of Classification Search
CPC ..... G09G 2320/029; G09G 2320/0285; G09G 2320/0295; G09G 2320/043; G09G 2320/045; G09G 2340/0435; G09G 2360/18; H01L 27/32
See application file for complete search history.

(56) References Cited

U.S. PATENT DOCUMENTS

2007/0139543 A1* 6/2007 Goffin ..... H04N 5/2353 348/296
2009/0167648 A1* 7/2009 Jeon ..... G09G 3/3266 345/76
2012/0249476 A1* 10/2012 Schwartz ..... G06F 3/044 345/174
2013/0127692 A1* 5/2013 Yoon ..... G09G 3/3258 345/80
2013/0194229 A1* 8/2013 Sabo ..... G06F 3/0418 345/174
2014/0062331 A1* 3/2014 Nam ..... G09G 3/3233 315/226
2014/0084805 A1* 3/2014 Kim ..... G09G 3/2048 315/228
2015/0049075 A1* 2/2015 Lim ..... G09G 5/397 345/212
2015/0123953 A1* 5/2015 Shim ..... G09G 3/3233 345/205
2015/0170578 A1* 6/2015 Choi ..... G09G 3/3266 345/212
2015/0213757 A1* 7/2015 Takahama ..... G09G 3/3233 345/691
2016/0189620 A1* 6/2016 Park ..... G09G 3/3258 345/690
2016/0351122 A1* 12/2016 Jung ..... G09G 3/2085
2017/0031485 A1* 2/2017 Kim ..... G06F 3/044
2017/0038898 A1* 2/2017 Kim ..... G02F 1/13338
2017/0046006 A1* 2/2017 Kim ..... G06F 3/0418
2017/0061860 A1* 3/2017 Park ..... G09G 3/3648
2017/0124947 A1* 5/2017 Kim ..... G09G 3/3233
2017/0193912 A1* 7/2017 Choi ..... G09G 3/3291
2017/0193971 A1 7/2017 Bi et al.
2018/0059868 A1* 3/2018 Brahma ..... G06F 3/0418
2018/0188796 A1* 7/2018 Feekes, Jr. ..... G06F 1/28

* cited by examiner

| Variable Frequency [Hz] | 144 (Ref) | 120 | 100 | 90 | 80 | 60 |
|---|---|---|---|---|---|---|
| VBP Time [ms] (Vertical Front Porch) | – | 1.39 | 3.06 | 4.17 | 5.56 | 9.72 |
| No. of RT / Frame | 1 | 4 | 6 | 10 | 13 | 22 |
| Update Time [sec] | 120 | 72 | 24 | 21 | 18 | 14 |

ORGANIC LIGHT EMITTING DISPLAY DEVICE AND DRIVING METHOD THEREOF

CROSS-REFERENCE TO RELATED APPLICATIONS

This application claims the benefit of Republic of Korea Patent Application No. 10-2018-0067669 filed on Jun. 12, 2018, which is incorporated by reference in its entirety.

BACKGROUND

Field of the Technology

The present document relates to a display device of an active matrix type.

Discussion of the Related Art

Flat display devices are widely used not only as a monitor of a desktop computer, but also as a portable computer such as a lap computer, a personal digital assistant PDA or a mobile terminal, owing to their advantages in downsizing and lightening. The flat display devices includes a liquid crystal display LCD, a plasma display panel PDP, an organic light emitting display, and so on. Especially, the organic light emitting display of an active matrix type including an organic light emitting diode OLED has the advantages of high response speed, large luminous efficiency, high brightness and wide viewing angle.

The organic light emitting display adopts an external compensation scheme to improve display quality. The external compensation scheme compensates for driving characteristic deviations among pixels by sensing pixel voltages or pixel currents reflecting the driving characteristics (or electric characteristics) of pixels and modulating input image data based on the sensing results.

SUMMARY

Sense driving for pixels is performed within the vertical blank period during which an input image is not written. The vertical blank period is much shorter than the vertical active period during which the input image is written. Since in a conventional sense driving method the driving characteristics for the pixels in one pixel line are sensed within one vertical blank period, the total time required for the updated compensation which senses and compensates for all pixel lines is inevitably prolonged. The time required for the updated compensation increases as the area of the display panel increases and the resolution increases. There is a need for a new scheme capable of reducing the time required for the updated compensation while maintaining the accuracy of compensation in an organic light emitting display device having a large area and a high resolution.

Accordingly, an objective of the present disclosure is to provide the organic light emitting display device and the driving method for the same which can reduce the time required for the updated compensation.

The organic light emitting display device according to an embodiment of the present disclosure comprises: an input unit configured to receive image data input at a variable frame frequency; a sensing control unit configured to generate a sensing control signal for sensing pixels to which the image data is to be applied, in a vertical blank period varying according to the variable frame frequency; and a TFT compensating unit configured to sense driving characteristics of a driving element included in the pixels according to the sensing control signal to output a first sensing result, wherein among one variable frame period, a vertical active period for applying the image data to the pixels is fixed and the vertical blank period in which no image data is applied to the pixels is varied according to the variable frame frequency.

And, the method of driving an organic light emitting display device according to another embodiment of the present disclosure comprises an input step of receiving image data input at a variable frame frequency, and fixing a vertical active period in which the image data exists and varying a vertical blank period in which no image data exists among one variable frame period which varies according to the variable frame frequency; a sensing control step of generating a sensing control signal for sensing pixels to which the image data is to be applied in the vertical blank period varying according to the variable frame frequency; and a TFT compensating step of sensing driving characteristics of a driving element included in the pixels according to the sensing control signal to output a first sensing result.

BRIEF DESCRIPTION OF THE DRAWINGS

The accompanying drawings, which are included to provide a further understanding of the present disclosure and are incorporated in and constitute a part of this specification, illustrate embodiments of the present disclosure and together with the description serve to explain the principles of the present disclosure. In the drawings.

DETAILED DESCRIPTION

Figure 1:
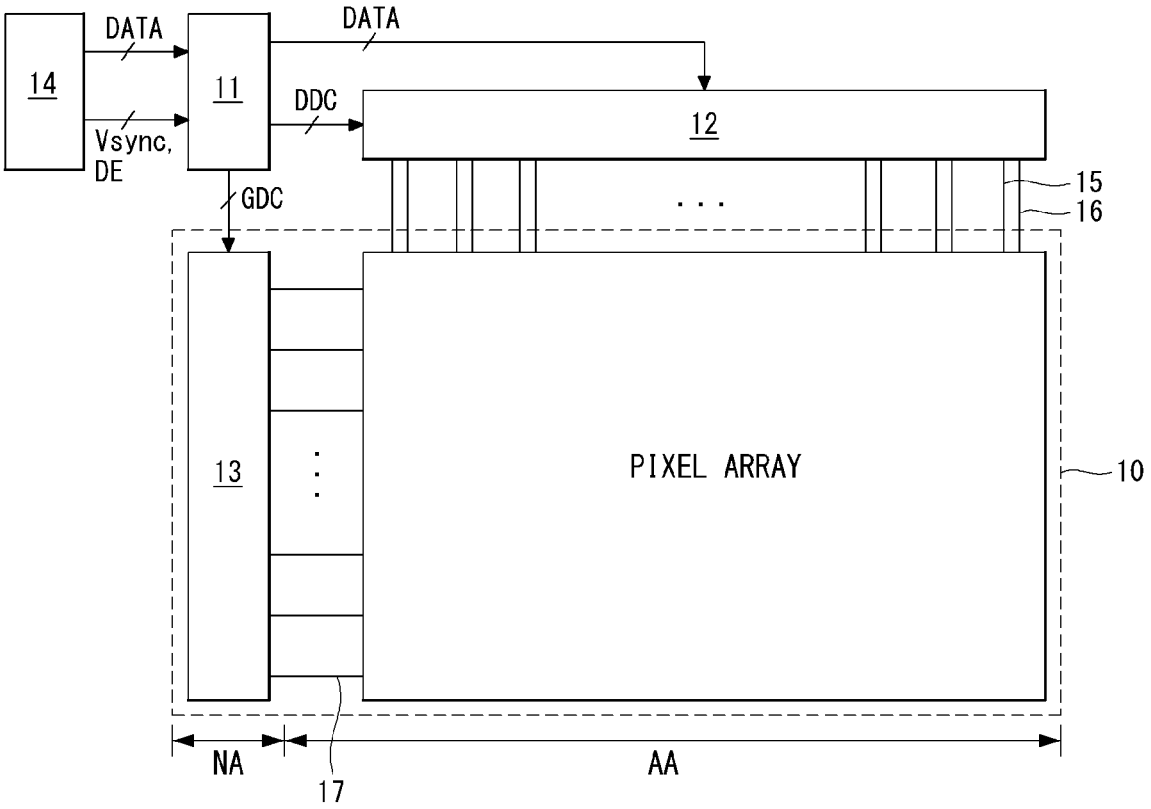
FIG. 1 is a block diagram illustrating a display device according to an embodiment of the present disclosure.

The advantages and features of the present disclosure and methods of accomplishing the same may be understood more readily by reference to the following detailed descriptions of exemplary embodiments and the accompanying drawings. The present disclosure may, however, be embodied in many different forms and should not be construed as being limited to the exemplary embodiments set forth herein. Rather, these exemplary embodiments are provided so that this disclosure will be thorough and complete and will fully convey the concept of the present disclosure to those skilled in the art, and the present disclosure is defined by the appended claims.

The shapes, sizes, percentages, angles, numbers, etc. shown in the figures to describe the exemplary embodiments of the present disclosure are merely examples and not limited to those shown in the figures. Like reference numerals denote like elements throughout the specification. When the terms 'comprise', 'have', and the like are used, other parts may be added as long as the term 'only' is not used. The singular forms may be interpreted as the plural forms unless explicitly stated.

The elements may be interpreted to include an error margin even if not explicitly stated.

When the position relation between two parts is described using the terms 'on', 'over', 'under', 'next to' and the like, one or more parts may be positioned between the two parts as long as the term 'immediately' or 'directly' is not used.

It will be understood that, although the terms first, second, etc., may be used to describe various elements, these elements should not be limited by these terms. These terms are only used to distinguish one element from another element. Thus, a first element referred to below may be a second element within the scope of the present disclosure.

Like reference numerals substantially denote like elements throughout the specification.

In this specification, the pixel circuit and the gate driver formed on the substrate of a display panel may be implemented by a thin film transistor (TFT) of an n-type MOSFET structure, but the present disclosure is not limited thereto so the pixel circuit and the gate driver may be implemented by a TFT of a p-type MOSFET structure. The TFT or the transistor comprises three electrodes including a gate, a source, and a drain. The source is an electrode for supplying a carrier to the transistor. Within the TFT the carrier begins to flow from the source. The drain is an electrode from which the carrier exits the TFT. That is, the carriers in the MOSFET flow from the source to the drain. In the case of the n-type MOSFET NMOS, since the carrier is an electron, the source voltage has a voltage lower than the drain voltage so that electrons can flow from the source to the drain. In the n-type MOSFET, a current direction is from the drain to the source because electrons flow from the source to the drain. On the other hand, in the case of the p-type MOSFET PMOS, since the carrier is a hole, the source voltage has a voltage higher than the drain voltage so that holes can flow from the source to the drain. In the p-type MOSFET, a current direction is from the source to the drain because holes flow from the source to the drain. It should be noted that the source and drain of the MOSFET are not fixed. For example, the source and drain of the MOSFET may vary depending on the applied voltage. Therefore, in the description of the present disclosure, one of the source and the drain is referred to as a first electrode, and the other one of the source and the drain is referred to as a second electrode.

Hereinafter, various embodiments of the present disclosure will be described in detail with reference to the accompanying drawings. In the following embodiments, an electroluminescent display device will be described mainly with respect to an organic light emitting display device including organic light emitting material. However, the present disclosure is not limited to the organic light emitting display device, but may be applied to an inorganic light emitting display device including inorganic light emitting material.

In describing the present disclosure, detailed descriptions of well-known functions or configurations related to the present disclosure will be omitted to avoid unnecessary obscuring the present disclosure.

Figure 2:
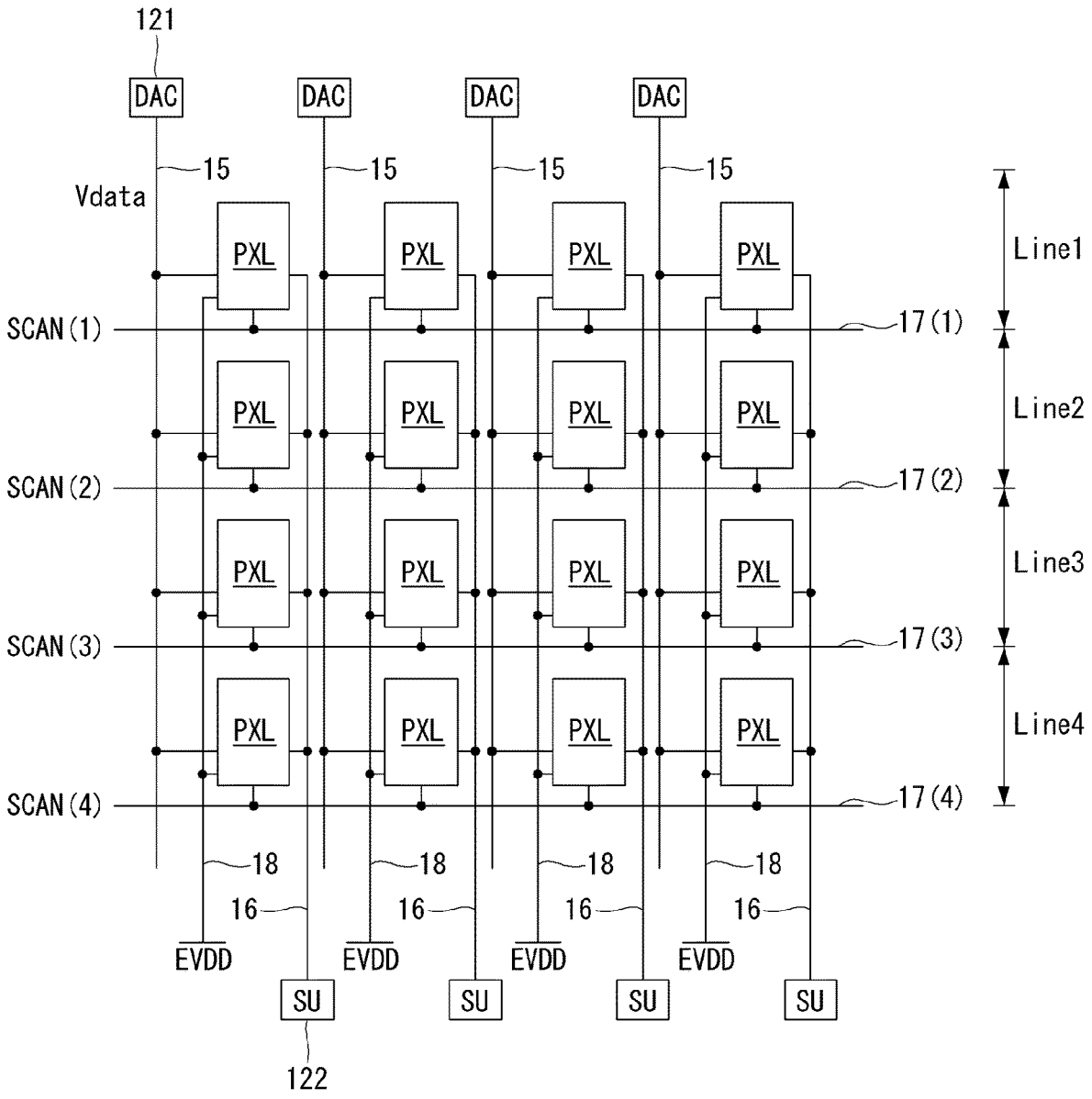
FIG. 2 shows a pixel array included in the display device of FIG. 1 according to an embodiment of the present disclosure.
Figure 3:
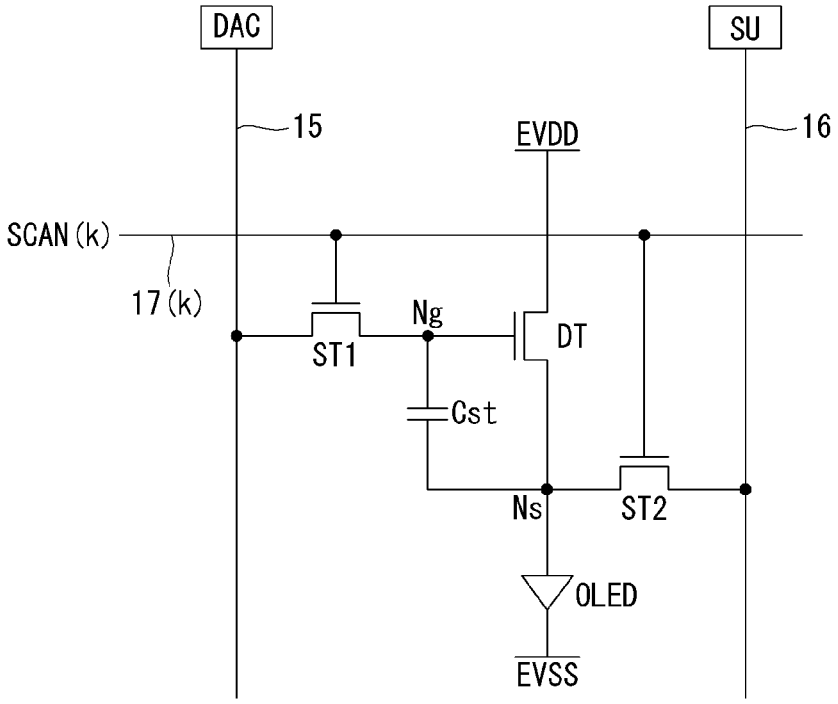
FIG. 3 shows a pixel included in the pixel array in FIG. 2 according to an embodiment of the present disclosure.

FIG. 1 is a block diagram illustrating a display device according to an embodiment of the present disclosure, FIG. 2 shows a pixel array included in the display device of FIG. 1 and FIG. 3 shows a pixel included in the pixel array in FIG. 2.

Referring to FIGS. 1 to 3, the display device according to the embodiment of the present disclosure may comprise a display panel 10, a timing controller 11, and panel drivers 12 and 13. The panel drivers 12 and 13 comprise a data driver 12 for driving the data lines 15 in the display panel 10 and a gate driver 13 for driving the gate lines 17 in the display panel 10.

A plurality of data lines 15, reference voltage lines 16 and a plurality of gate lines 16 are laid in the display panel 10. Pixels PXL may be disposed in an area where the plurality of data lines 15, reference voltage lines 16, and a plurality of gate lines 16 cross each other on the display panel 10. The pixel array such as FIG. 2 may be formed in a display area AA of the display panel by the pixels PXL disposed in a matrix form.

In the pixel array, the pixels PXL may be separated line by line based on one direction. For example, the pixels PXL may be separated into a plurality of pixel lines Line 1 to line 4 each of which is extended along a direction (or a horizontal direction) in which the gate lines are extended. Here, the pixel line does not mean a physical signal line, but an aggregate of pixels PXL arranged adjacent to each other along the horizontal direction. So, the pixels PXL comprising a same pixel line may be connected to a same gate line 17.

In the pixel array, each pixel PXL may be connected to a digital-analog converter (DAC) 121 via the data line 15 and connected to the reference voltage line 16 through a sensing unit (SU) 122. The reference voltage line 16 may be further connected to the DAC 121 to supply a reference voltage. The DAC 121 and the SU 122 may be embedded in the data driver 12, but are not limited thereto.

In the pixel array, each pixel PXL may be connected to a high voltage power source EVDD via a high voltage power line 18. And, each pixel PXL may be connected to the gate driver 13 via the gate line 17(1)-17(4).

In the pixel array, the pixels may include the pixels of a first color, the pixels of a second color and the pixels of a third color pixels, and may further comprise the pixels of a fourth color. The first to fourth colors may be different from each other and each of the first to fourth colors may be one of red, green, blue and white.

Each pixel PXL may be implemented as such FIG. 3. One pixel PXL disposed in the k-th pixel line (k is an integer) may comprise an OLED, a driving TFT DT, a storage capacitor Cst, a first switch TFT ST1 and a second switch TFT ST2. The first and second switch TFT ST1 and ST2 may be connected to a same gate line 17(*k*).

The OLED is a light emitting element. The OLED may include an anode electrode connected to a source node Ns, a cathode electrode connected to an input terminal of a low voltage power source EVSS, and an organic compound layer disposed between the anode electrode and the cathode electrode. The driving TFT DT is a driving element. The driving TFT DT controls a driving current flowing through the OLED according to the voltage difference between a gate node Ng and a source node Ns. The driving TFT DT comprises a gate electrode connected to the gate node Ng, a first electrode connected to the input terminal of the high voltage power source EVDD, and a second electrode connected to the source node Ns. The storage capacitor Cst is connected between the gate node Ng and the source node Ns to store the voltage between the gate and source electrodes of the driving TFT DT.

The first switch TFT ST1 turns on the current flow between the data line 15 and the gate node Ng according to a gate signal SCAN(k), to apply to the gate node Ng the data voltage charged in the data line 15. The first switch TFT ST1 comprises a gate electrode connected to the gate line 17(*k*), a first electrode connected to the data line 15, and a second electrode connected to the gate node Ng. The second switch TFT ST2 turns on the current flow between the reference voltage line 16 and the source node Ns according to the gate signal SCAN(k), to apply to the source node Ns the reference voltage charged in the reference voltage line 16 or to transfer the voltage of the source node Ns determined by a pixel current to the reference voltage line 16. The second switch TFT ST2 is equipped with a gate electrode connected to the gate line 17(*k*), a first electrode connected to the reference voltage line 16 and a second electrode connected to the source node Ns.

Such a pixel structure is merely an example. The technical idea of the present disclosure is not limited to a pixel structure or the like.

The timing controller 11 may generate data control signals DDC for controlling operation timings of the data driver 12 and gate control signals GDC for controlling operation timings of the gate driver 13 based on timing signals such as a vertical synchronization signal Vsync, a data enable signal DE, and so on input from a host system 14. The gate control signals GDC include a gate start signal, gate shift clocks, and the like. The gate start signal activates a first stage of the gate driver 13. The gate shift clocks control the operations and outputs of the stages of the gate driver 13. The data control signals DDC includes a source start pulse, a source sampling clock, and a source output enable signal, and the like. The source start pulse controls a data sampling start timing of the data driver 12. The source sampling clock controls a sampling timing of data based on a rising or falling edge. The source output enable signal controls an output timing of the data driver 12.

The timing controller 11 may sense the driving characteristics of pixels in real-time during displaying image, by controlling the timings of display driving and sense driving for the pixel lines of the display panel 10 based on the timing control signals GDC and DDC.

Here, the sense driving means the operations in which sensing data is written to the pixels PXL arranged on a specific pixel line to sense the driving characteristics of the pixels PXL and the compensation values for compensating for the changes of the driving characteristics of the pixels PXL based on the sensing results are updated. Hereinafter, the operation for writing the sensing data to the pixels PXL disposed in a specific pixel line during the sense driving is referred to as a Sensing Data Writing SDW driving.

The display driving means the operations in which input image data is written to pixel lines in one frame to reproduce the input image on the display panel 10. The operation for writing the input image data to the pixel lines is referred to as an Image Data Writing IDW driving.

The timing controller 11 may implement the IDW driving in a vertical active period among one frame and implement the SDW driving in a vertical blank period among one frame during which the IDW driving is not performed.

When a frame frequency is varied according to input image, the timing controller may receive image data according to the variable frame frequency. Here, in one frame period varying according to the variable frame frequency, the vertical active period for applying the image data exists to the pixels may be fixed, while the vertical blank period in which no image data is applied to the pixels may vary according to the variable frame frequency. The length of the vertical blank period may be varied in inverse proportion to the speed of the variable frame frequency. At this time, the timing controller 11 may reduce the time required for the updated compensation by increasing the number of sensing times the SDW driving is performed (i.e., the number of the pixel lines to be sensed) as the length of the variable vertical blank period becomes longer.

The timing controller 11 may utilize the SDW driving based on the variable vertical blank period in first and second compensating modes. The first compensating mode only compensates for only the driving characteristic change of the driving TFT DT within the variable vertical blank period. On the other hand, the second compensating mode compensates for both the driving characteristic change of the driving TFT DT and the OLED, and selectively compensates for the driving characteristic change of the driving TFT DT and the OLED according to the length of the variable vertical blank period. If the first compensating mode is adopted, only the updated compensation may be quickly processed for the driving TFT DT. Since the updated compensation for both of the driving TFT DT and the OLED can be processed when the second compensating mode is adopted, the second compensating mode is more advantageous in terms of the accuracy of compensation.

The gate drier 13 generates gate signals SCAN based on the gate control signals DDC from the timing controller 11. The gate driver may sequentially supply the gate signals SCAN for IDW to the gate lines 17 to implement the IDW driving. The gate driver may sequentially supply the gate signals SCAN for SDW to the gate lines 17 to implement the SDW driving or may supply the gate signals SCAN for SDW in a non-sequential manner Especially, in the case of the non-sequential supply, it is possible to solve the problem that the pixel line on which the SDW driving is performed is recognized as a line dim.

The gate driver 13 may be embedded in a non-display area NA of the display panel 10 in accordance with a gate driver in panel scheme GIP.

The data driver 12 includes a plurality of DACs 121 and a plurality of sensing units (SU) 122. The DAC 121 converts input image data into the data voltage for IDW Vdata and sensing data into the data voltage for SDW Vdata based on the data control signals DDC output from the timing controller 11. The DAC 121 generates the reference voltage to be applied to the pixels PXL.

The DAC 121 may output the data voltage for IDW Vdata to the data lines 15 and the reference voltage to the reference voltage lines 16 in synchronization with the gate signals for IDW SCAN, for implementing the IDW driving.

The DAC 121 sets up the pixel line to be sensed by outputting the data voltage for SDW Vdata to the data lines 15 and the reference voltage to the reference voltage lines 16 in synchronization with the gate signal SCAN for SDW, for implementing the SDW driving. The sensing units SUs 122 sense the pixel currents flowing through the pixels PXL of the pixel lines to be sensed via the reference voltage lines 16. After completing the sensing, the DAC 121 restores the display state of the sensed pixel line to be same as the state immediately before the sensing, by outputting the restoring voltage for SDW to the data lines 15 in synchronization with the gate signal SCAN for SDW, thereby preventing the sensed pixel line from being viewed as a line dim. The restoring voltage for SDW may be the data voltage Vdata for IDW.

Figure 4:
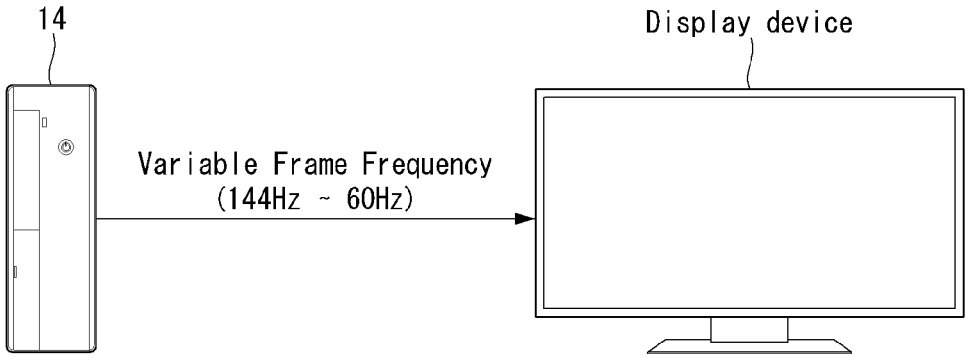
FIG. 4 shows that a host system and the display device communicate image data in a variable frame-frequency method according to an embodiment of the present disclosure.

FIG. 4 shows that a host system and the display device communicate image data in a variable frame-frequency method.

Referring to FIG. 4, image data is sent and received between the host system 14 and the display device according to a variable frame frequency method. The host system 14 may be a graphic card, but limited thereto. The host system 14 detects the amount of change of the input image data on a frame-by-frame basis, and changes the frame frequency according to the amount of change of the image data, thereby resolving the problems such as image jerkiness, screen jitter, and input delay due to abrupt image change. When the variation amount of the video data is relatively large, the host system 14 may increase the frame frequency within a predetermined frequency range. On the other hand, when the variation amount of the video data is relatively small, the host system 14 can decrease the frame frequency within a predetermined frequency range. For example, the host system 14 may adjust the frame frequency within the frequency range of 60 Hz to 144 Hz according to the variation amount of the image data.

Figure 5:
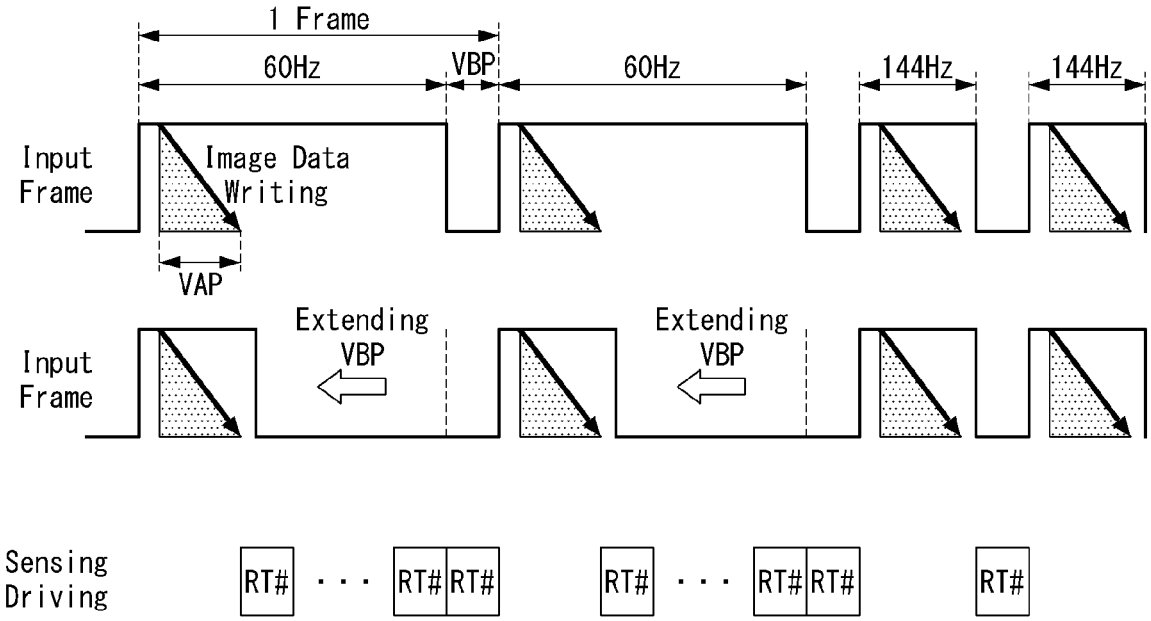
FIG. 5 is a diagram illustrating that a sense driving is performed within a vertical blank period whose length varies according to the variable frame frequency method according to an embodiment of the present disclosure.

FIG. 5 is a diagram illustrating that a sense driving is performed within a vertical blank period whose length varies according to the variable frame frequency method.

Referring FIG. 5, one frame period varies according to a frame frequency. One frame period of 60 Hz is longer than that of 144 Hz. In this variable frame frequency technique, the vertical active period VAP in which the image data is written is fixed regardless of the change in the frame frequency, and the vertical blank period VBP changes corresponding to the change in the frame frequency.

The timing controller 11 may increase the number of sensing times RT # per frame within the vertical blank period VBP that varies according to the variable frame frequency. For example, the number of sensing times per frame may be larger when the frame frequency is 60 Hz as compared with the case where the frame frequency is 144 Hz.

Figures 6, 7:
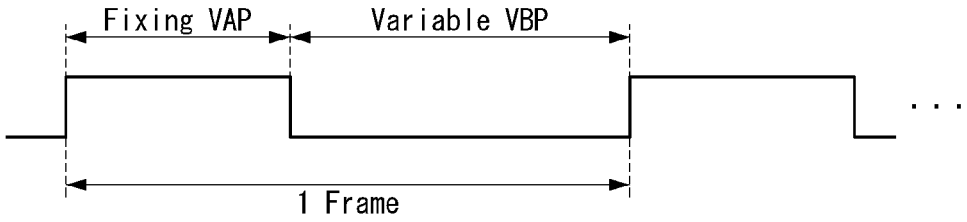
FIG. 6 shows the table including the number of sensing times and the time required for the updated compensation for respective lengths of the vertical blank period according to an embodiment of the present disclosure.
FIGS. 7 and 8 show that among a variable one frame period the vertical active period is fixed and only the vertical blank period varies according to a variable frame frequency according to an embodiment of the present disclosure.

Referring to FIG. 6, the number of sensing times RT # per frame according to the frame frequency and the time for updated compensation time will be described below.

Referring to FIG. 6, when the frame frequency is 144 Hz no vertical front porch section is included in the vertical blank period VBP, the number of sensing times RT # per frame is 1, and the time required for the updated compensation is 120 seconds.

When the frame frequency is 120 Hz, the vertical front porch section included in the vertical blank period VBP is 1.39 msec, the number of sensing times RT # per frame is 4, and the time required for the updated compensation is 72 seconds.

When the frame frequency is 100 Hz, the vertical front porch section included in the vertical blank period VBP is 3.06 msec, the number of sensing times RT # per frame is 6, and the time required for the updated compensation is 24 seconds.

When the frame frequency is 90 Hz, the vertical front porch section included in the vertical blank period VBP is 4.17 msec, the number of sensing times RT # per frame is 10, and the time required for the updated compensation is 21 seconds.

When the frame frequency is 80 Hz, the vertical front porch section included in the vertical blank period VBP is 5.56 msec, the number of sensing times RT # per frame is 13, and the time required for the updated compensation is 18 seconds.

When the frame frequency is 60 Hz, the vertical front porch section included in the vertical blank period VBP is 9.72 msec, the number of sensing times RT # per frame is 22, and the time required for the updated compensation is 14 seconds.

As the frame frequency increases, the vertical front porch section included in the vertical blank period VBP becomes longer. This is because the vertical active period is fixed based on the fastest frame frequency and the remaining vertical active period is used as the vertical front porch section. At this time, if the SDW driving is further performed using the increased vertical blank interval VBP, the number of sensing times RT # per frame may be increased. The increase in the number of sensing times RT # per frame means the increase in the number of sensing lines to be sensed per frame. So, as the number of sensing times RT # per frame increases, the time required for the updated compensation for all pixel lines becomes shorter. When the time required for the updated compensation is shortened, the driving characteristic change of pixels may be compensated quickly and the reliability and accuracy of the compensation may be enhanced.

Figure 8:
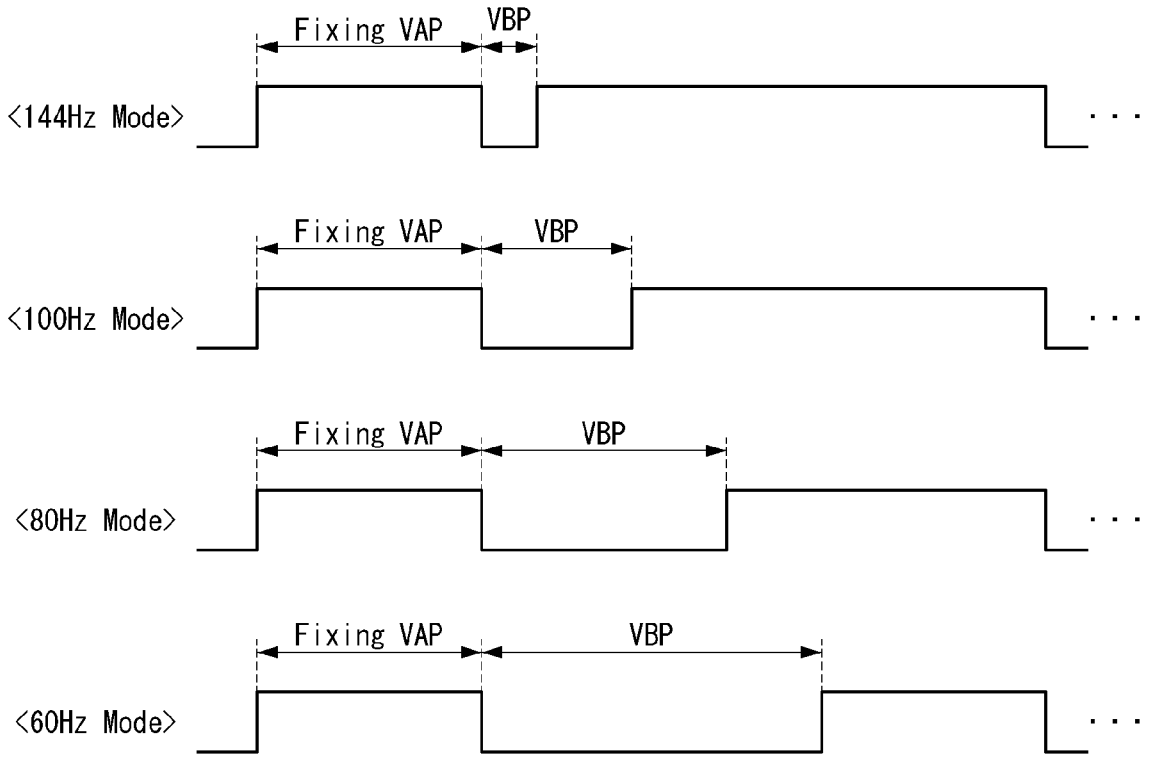

FIGS. 7 and 8 show that among a variable one frame period the vertical active period is fixed and only the vertical blank period varies according to a variable frame frequency.

Referring to FIG. 7, the input image is input from the host system 14 to an organic light emitting display device while the frame frequency of the input image varies. At this time, the vertical active period VAP is fixed based on the fastest frame frequency within a predetermined frame frequency range, and input image data is transferred from the host system 14 to the display device in synchronization the pixel clock fixed based on the fastest frame frequency. If the pixel clock synchronized with the input image data is also changed whenever the frame frequency is changed, design complexity may become very large. As the present disclosure, if the vertical active period VAP is fixed by using the fixed pixel clock in spite of the variable frame frequency, it is advantageous to avoid the design complexity and increase data transmission efficiency.

Referring to FIG. 8, when the variable frame frequency range is 60 Hz to 144 Hz and the frame frequency changes to one of 144 Hz, 100 Hz, 80 Hz, and 60 Hz, the vertical active period VAP may be fixed based on 144 Hz. At this time, the vertical blank period VBP may be gradually increased corresponding to the frame frequency changing to 144 Hz, 100 Hz, 80 Hz, and 60 Hz.

Figure 9:
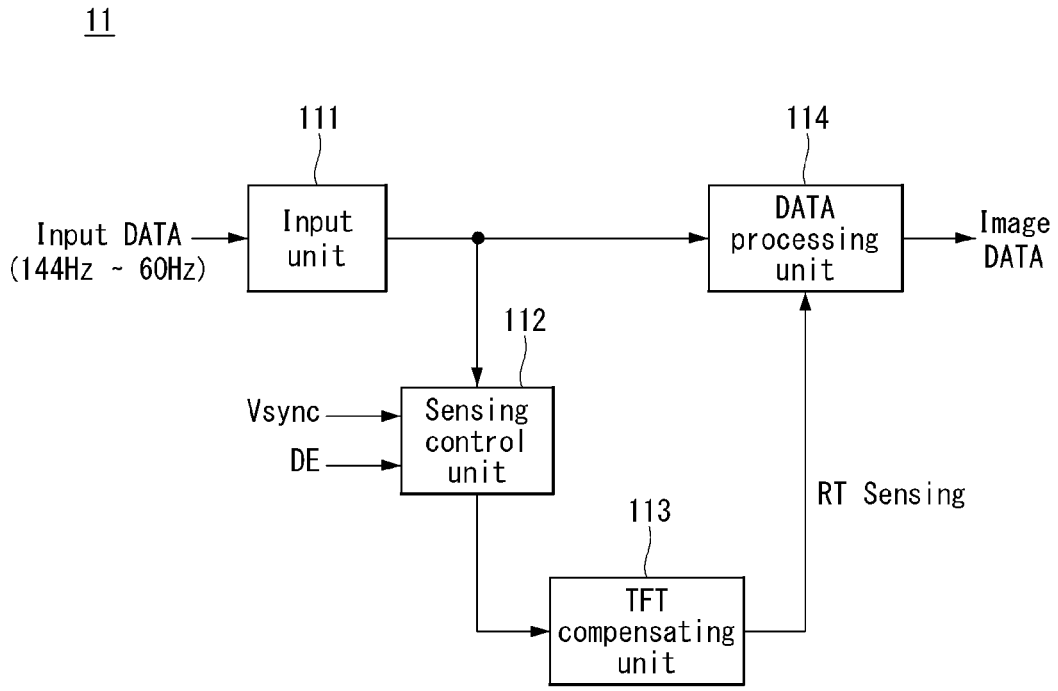
FIG. 9 shows the internal configuration of the timing controller in FIG. 1 which can perform only a TFT compensation according to an embodiment of the present disclosure.
Figure 10:
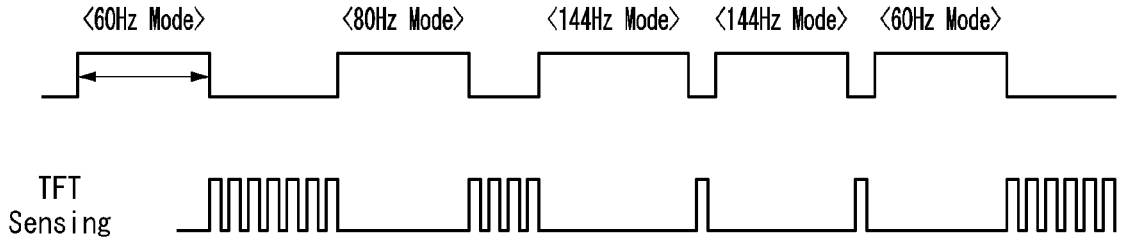
FIG. 10 is a diagram for describing the TFT sensing operation which is performed within the variable vertical blank period according to an embodiment of the present disclosure.

FIG. 9 shows the internal configuration of the timing controller in FIG. 1 which can perform only a TFT compensation, and FIG. 10 is a diagram for describing the TFT sensing operation which is performed within the variable vertical blank period.

Referring to FIG. 9, the timing controller 11 may compensate for only the driving characteristic change of the driving TFT DT in the variable vertical blank period according to a first compensating mode. Real-time compensation proceeds continuously within the variable vertical blank period. The sensing operation is stopped when the vertical blank period ends. Since the vertical blank period is different according to the frame frequency, the number of sensing times may be variable according to the frame frequency. In this case, there is no need for a separate frequency detecting circuit.

Specifically, the timing controller 11 may include an input unit 111, a sensing control unit 112, and a TFT compensating unit 113 to compensate for only the driving characteristic change of the driving TFT DT within the variable vertical blank period, and may further include a data processing unit 114.

The input unit 111 receives image data transmitted in accordance with a variable frame frequency from the host system. At this time, among one frame period varied according to the variable frame frequency, the vertical active period in which the image data exists is fixed based on the fastest frame frequency in the predetermined frame frequency range. On the other hand, the vertical blank period in which no image data exists varies according to the variable frame frequency. As describe above, since the image data is transmitted in synchronization with the pixel clock fixed based on the fastest frame frequency, the vertical active period may be fixed.

The sensing unit 112 generates a control signal for sensing the characteristics of the pixels to which the image data is to be written, within the vertical blank period whose length varies according to the variable frame frequency. The sensing unit 112 may recognize the variable vertical blank period based on a vertical synchronization signal Vsync toggling at intervals of one variable frame period and the data enable signal DE for informing the presence of image data. So, it is advantageous to simplify circuit logic by eliminating the need for a separate frequency detector in the timing controller 11.

The TFT compensating unit 113 senses the driving characteristics of the driving TFT included in the pixels according to the sensing control signal and outputs a first sensing result. The driving characteristics of the driving TFT may include the threshold voltage of the driving TFT and/or the electron mobility of the driving TFT. The threshold voltage and electron mobility are important factors determining the driving current flowing through the driving TFT. So, if compensating for the change of the threshold voltage and electron mobility, the reliability of the driving TFT is improved. At this time, the sense driving frequency according to the operation of the TFT compensating unit 113 is set to be the same regardless of the length of the vertical blank period. In this way, there is no increase in power with increasing frequency, which enables it easy to reduce power consumption.

The data processing unit 114 may compensate for the driving characteristic change of the pixels, that is the driving characteristic change of the driving TFT by modulating the image data based on the first sensing result.

In this way, the length of the vertical blank period varies in inverse proportion to the speed of the variable frame frequency, and as the length of the vertical blank period becomes longer the number of sensing times per frame increases as shown in FIG. 10. So the time required for the updated compensation may be greatly reduced.

Figure 11:
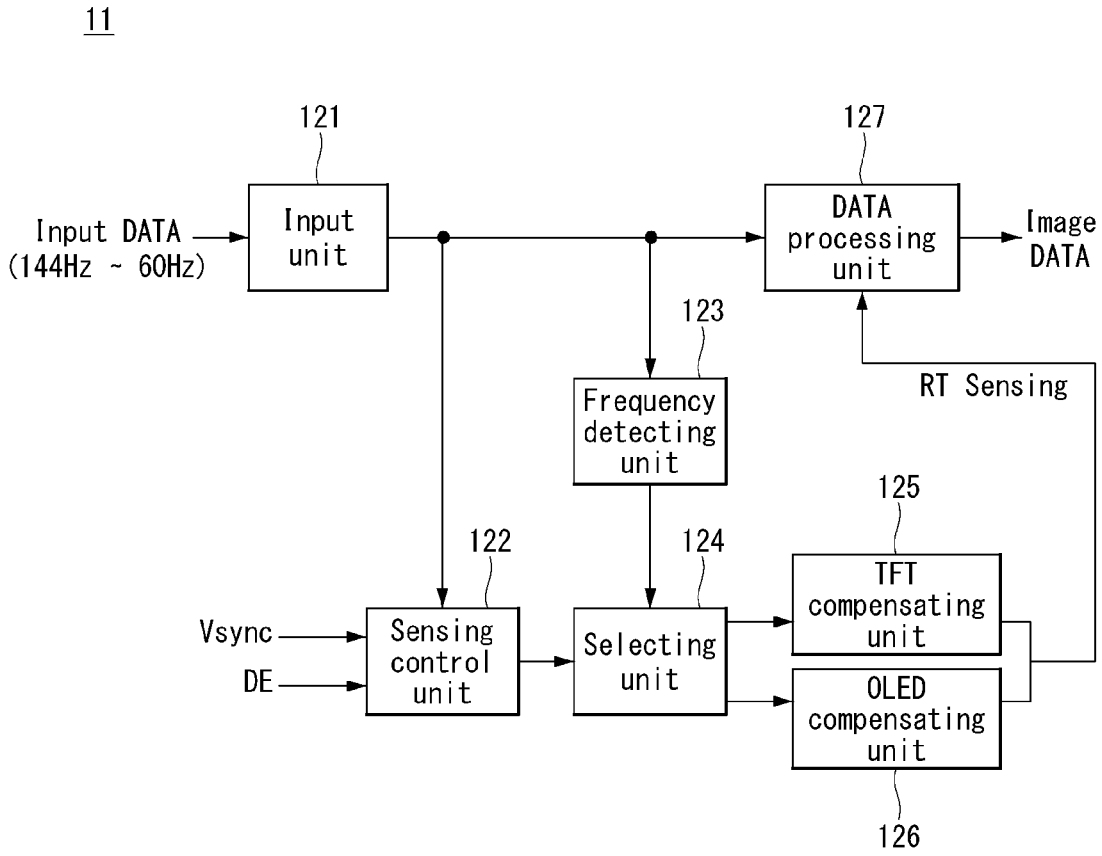
FIG. 11 shows the internal configuration of the timing controller in FIG. 1 which can perform an OLED compensation and a TFT compensation according to an embodiment of the present disclosure.
Figure 12:
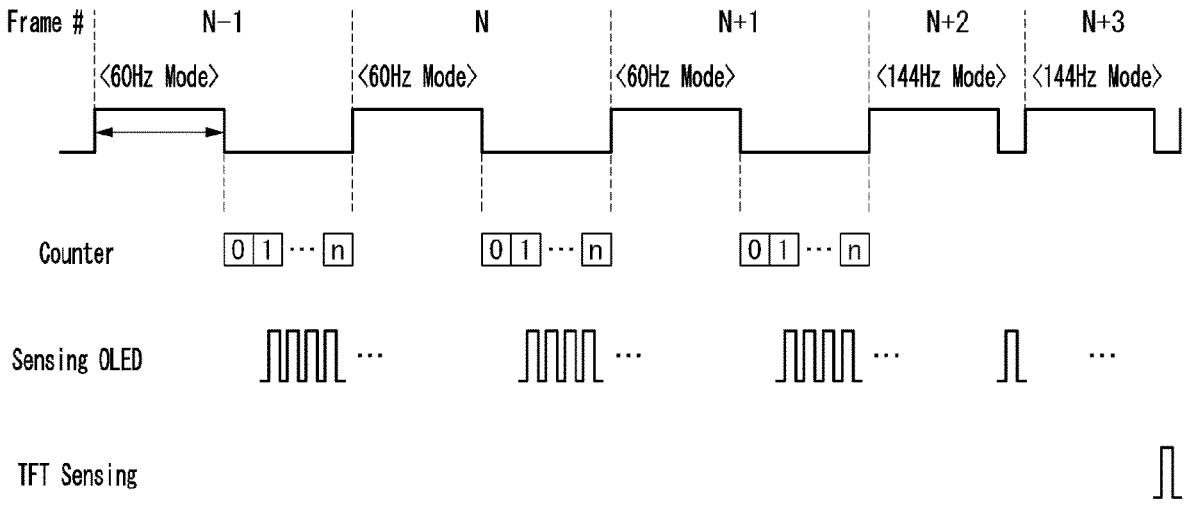
FIG. 12 is a diagram for describing the TFT sensing operation and the OLED sensing operation which are selectively performed within the variable vertical blank period according to an embodiment of the present disclosure.

FIG. 11 shows the internal configuration of the timing controller in FIG. 1 which can perform an OLED compensation and a TFT compensation, and FIG. 12 is a diagram for describing the TFT sensing operation and the OLED sensing operation which are selectively performed within the variable vertical blank period.

Referring to FIG. 11, the timing controller 11 may compensate for both the driving characteristic change of the driving TFT DT and the driving characteristic change of the OLED within a variable vertical blank period according to a second compensating mode. The timing controller 11 detects a varying frame frequency, performs a TFT compensating operation if the detected frame frequency is relatively high and performs an OLED compensating operation if the detected frame frequency is relatively low. Because the time required for the OLED compensating operation is longer than that for the TFT compensating operation per pixel, the OLED sensing operation (or the OLED compensating operation) cannot be performed if the vertical blank period is not long enough. So, the compensating operations may be dualized. In this case, the timing controller 11 further needs a frequency detecting circuit for determining a frame frequency.

Specifically, the timing controller 11 may include an input unit 121, a sensing control unit 122, a frequency detecting unit 123, a selecting unit 124, a TFT compensating unit 125, and an OLED compensating unit 126, and may further include a data processing unit 127, in order to compensate for both the driving characteristic change of the driving TFT DT and the driving characteristic change of the OLED within a variable vertical blank period.

The input unit 121 receives image data transmitted in accordance with a variable frame frequency from the host system. At this time, among one frame period varied according to the variable frame frequency, the vertical active period in which the image data exists is fixed based on the fastest frame frequency in the predetermined frame frequency range, on the other hand, the vertical blank period in which no image data exists varies according to the variable frame frequency. As describe above, since the image data is transmitted in synchronization with the pixel clock fixed based on the fastest frame frequency, the vertical active period may be fixed.

The sensing control unit 122 generates a control signal for sensing the characteristics of the pixels to which the image data is to be written, within the vertical blank period whose length varies according to the variable frame frequency.

The frequency detecting unit 123 may be a counter and detect a variable frame frequency by counting the vertical blank periods using the counter.

The selecting unit 124 selectively activates the operations of the TFT compensating unit 125 and the OLED compensating unit by comparing the detected frame frequency with a predetermined reference value. The selecting unit 124 activates the operation of the TFT compensating unit 125 when the detected frame frequency is equal to or greater than the reference value, and activates the operation of the OLED compensating unit 126 when the detected frame frequency is less than the reference value. When the range of the variable frame frequency is 60 Hz to 144 Hz, the reference value may be for example 90 Hz, but limited thereto.

The TFT compensating unit 125 senses the driving characteristics of the driving TFT included in the pixels according to the sensing control signal to output a first sensing result. The driving characteristics of the driving TFT may include at least one of the threshold voltage and the electron mobility of the driving TFT.

The OLED compensating unit 126 senses the driving characteristics of the OLED included in the pixels according to the sensing control signal to output a second sensing result. The driving characteristics of the OLED may include the operating point voltage of the OLED. The operating point voltage is an important factor determining the light-emitting timing of the OLED. So if the operating point voltage is compensated for, the reliability of the OLED is improved.

Meanwhile, the sense driving frequency according to the operations of the TFT compensating unit 125 and the OLED compensating unit 126 is set to be the same regardless of the length of the vertical blank period. In this way, there is no increase in power with increasing frequency, which enables it easy to reduce power consumption.

The data processing unit 127 may compensate for the driving characteristic change of the pixels, that is the driving characteristic change of the driving TFT and the OLED by modulating the image data based on the first sensing result or the second sensing result.

In this way, the length of the vertical blank period varies in inverse proportion to the speed of the variable frame frequency, and as the length of the vertical blank period increases the number of sensing times per frame increases as shown in FIG. 12. So the time required for the updated compensation may be greatly reduced. If the compensating operations are dualized according to the frame frequency, it is possible to compensate for all the driving characteristic change of the driving TFT and the OLED and there is an advantage that reliability and accuracy of compensation are enhanced. As one example of the dualization, when the range of the variable frame frequency is 60 Hz to 144 Hz, the OLED compensating operation may be performed if the frame frequency corresponds to the frequency range of 60 Hz to 90 Hz, and the TFT compensating operation may be performed if the frame frequency corresponds to the frequency range of 90 Hz to 144 Hz.

Figure 13:
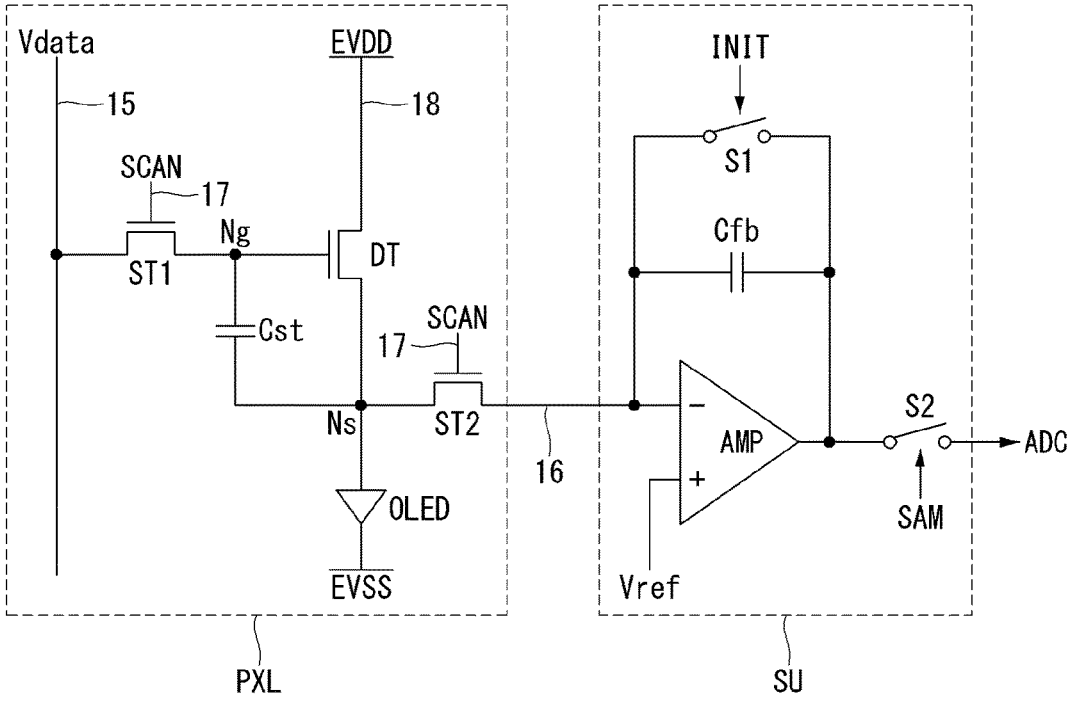
FIG. 13 shows the configuration of the sensing unit connected to a pixel according to an embodiment of the present disclosure.
Figure 14:
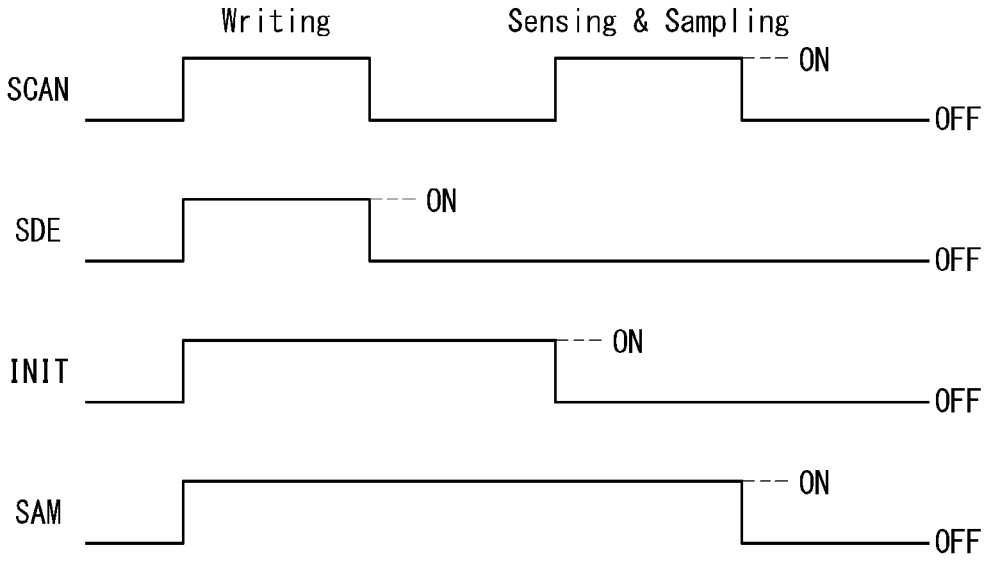
FIG. 14 shows the control signals applied to the pixel and the sensing unit in sense driving according to an embodiment of the present disclosure.

FIG. 13 shows the configuration of the sensing unit SU connected to a pixel, and FIG. 14 shows the control signals applied to the pixel and the sensing unit in sense driving.

The pixel according to the present disclosure was described with respect to FIG. 3.

The sensing unit of the present disclosure may be implemented by a current integrator like the sensing unit SU in FIG. 13, but the technical idea of the present disclosure is not limited thereto.

Referring to FIG. 13, the sensing unit SU comprises an amplifier AMP including the inverting input terminal (−) which is connected to the reference voltage line 16 to receive the pixel current of the driving TFT DT from the reference voltage line 16, the non-inverting input terminal (+) which receives the reference voltage Vref, and the output terminal outputting an integrated value, an integrating capacitor Cfb connected between the inverting input terminal (−) and the output terminal, and a first switch Si connected to both ends of the integrating capacitor Cfb. The first switch Si is turned on and turned off according to a reset signal INIT. And, the sensing unit SU of the present disclosure may further comprise a second switch S2 connected to the output terminal of the amplifier AMP, and is switched according to a sampling signal SAM.

Referring to FIG. 14, the operation of the sensing unit SU may be divided into a writing section and a sensing & sampling section.

In the writing section, the first switch Si is turned on and the amplifier AMP operates as a unit gain buffer with a gain of 1. In the writing section, the input terminals (+) and (−), the output terminal and the reference voltage line 16 are all initialized to the reference voltage Vpre.

In the writing section, the first switch TFT ST1 is turned on and the data voltage Vdata for sensing which is synchronized with a sensing data enable signal SDE is applied to the gate node Ng through the data line 15. In the writing section, the second switch TFT ST2 is turned on, so the source node NS is initialized to the reference voltage Vref. Accordingly, the pixel current corresponding to the voltage difference (Vdata−Vref) between the gate node Ng and the source node Ns flows through the driving TFT DT. However since the amplifier AMP continuously operates as a unit gain buffer in the writing section, the voltage of the output terminal maintains the reference voltage Vref.

In the sensing & sampling section, the first and second switch TFTs ST1 and ST2 maintain their turn-on states and the first switch Si is turned off, so the amplifier AMP operates as a current integrator to integrate the pixel current flowing through the driving TFT DT. In the sensing & sampling section, as sensing time elapses, that is as the amount of accumulated current increases, the voltage difference between both ends of the integrating capacitor Cfb increases owing to the pixel current input the inverting input terminal (−) of the amplifier AMP. Since the inverting input terminal (−) and the non-inverting terminal (+) of the amplifier AMP are shorted to each other via a virtual ground so the voltage difference therebetween is 0, the potential of the inverting input terminal (−) maintains the reference voltage Vref regardless of the increase in the voltage difference of the integrating capacitor Cfb in the sensing & sampling section. Instead, the potential of the output terminal of the amplifier AMP is lowered corresponding to the voltage difference between both ends of the integrating capacitor Cfb. With this principle, the pixel current input through the reference voltage line 16 during the sensing&sampling section is accumulated as a voltage value through the integrating capacitor Cfb. Since the falling slope of the output value of the current integrator increases as the pixel current input through the reference voltage line 16 increases, the magnitude of the sensing voltage becomes smaller as the pixel current becomes larger. That is, the voltage difference between the reference voltage Vref and the sensing voltage becomes larger in proportion to the pixel current. In the sensing&sampling section, the sensing voltage is stored to a sampling circuit during the second switch S2 maintains its turn-on state and then input to ADC. The sensing voltage is converted into a digital value by the ADC and then output to a data processor.

The integrating capacitor Cfb included in the current integrator is smaller in its capacitance than the line capacitor (parasitic capacitor) existing in the reference voltage line 16 by a factor of a hundred, so the time required to reach the sensing voltage is remarkably shortened. The current sensing method of the present disclosure can integrate and sample the pixel current of the driving TFT DT within shortened time, so sensing time can be greatly shortened.

Meanwhile, the sensing unit SU may sense the pixel current while not emitting the OLED when sensing the driving characteristics of the driving TFT DT, and may sense the pixel current while emitting the OLED when sensing the driving characteristics of the OLED.

Figure 15:
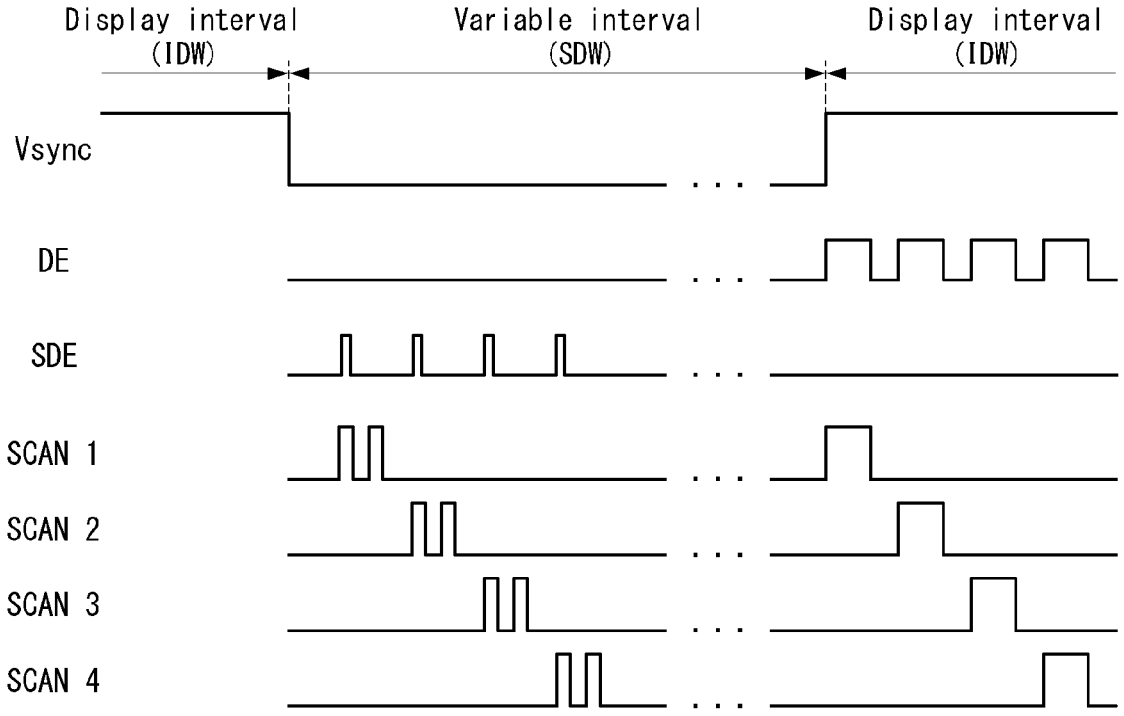
FIG. 15 shows the timing diagram for a display driving and the sense driving according to an embodiment of the present disclosure.

FIG. 15 shows the timing diagram for a display driving and the sense driving.

Referring to FIG. 15, the IDW driving is performed during the vertical active period (display interval and fixed interval) among one frame period, and the SDW driving is performed during the vertical blank period (variable interval) among one frame period.

The data enable signal DE synchronized with the image data is activated only in the vertical active period, and the sensing data enable signal SDE synchronized with the sensing data is activated only in the vertical blank period.

According to the present disclosure, the SDW driving for the plurality of pixel lines is possible in one vertical blank period since the vertical blank period can be extended. FIG. 15 shows that the plurality of gate signals for sensing SCAN1-SCAN4 are sequentially applied to a plurality of pixel lines in the vertical blank period, but the plurality of gate signals for sensing SCAN1-SCAN4 may be applied in a non-sequential manner As described above, the present disclosure varies the vertical blank period according to a frame frequency and may increase the number of sensing times for sensing the driving characteristics of pixels by using the variable vertical blank period. Accordingly, the present disclosure can reduce the time required for the updated compensation and quickly compensate for the driving characteristic change of the pixels, thereby greatly increasing the reliability and accuracy of compensation.

Throughout the description, it should be understood by those skilled in the art that various changes and modifications are possible without departing from the technical principles of the present disclosure. Therefore, the technical scope of the present disclosure is not limited to the detailed descriptions in this specification but should be defined by the scope of the appended claims.

What is claimed is:

1. An organic light emitting display device, comprising:

an input unit configured to receive image data input at a variable frame frequency;

a sensing control unit configured to generate a sensing control signal for sensing pixels to which the image data is to be applied, in a vertical blank period varying according to the variable frame frequency; and a thin film transistor (TFT) compensating unit configured to sense driving characteristics of a driving element included in the pixels according to the sensing control signal to output a first sensing result, wherein among one variable frame period, a vertical active period for applying the image data to the pixels is fixed and the vertical blank period in which no image data is applied to the pixels is varied according to the variable frame frequency.

2. The organic light emitting display device of claim 1, wherein the driving characteristics of the driving element include at least one of a threshold voltage and electron mobility of the driving element.

3. The organic light emitting display device of claim 1, wherein the vertical active period is fixed based on a fastest frame frequency within a predetermine range of the variable frame frequency.

4. The organic light emitting display device of claim 3, wherein the image data is synchronized with a pixel clock fixed based on the fastest frame frequency.

5. The organic light emitting display device of claim 1, wherein the sensing control unit recognizes the vertical blank period based on a vertical synchronization signal toggling at intervals of one variable frame period and a data enable signal for informing presence of the image data.

6. The organic light emitting display device of claim 5, wherein a length of the vertical blank period varies in inverse proportion to a speed of the variable frame frequency, and a number of sensing times per frame increases as the length of the vertical blank period becomes longer.

7. The organic light emitting display device of claim 6, further comprising:

an organic light emitting diode (OLED) compensating unit configured to sense the driving characteristics of a light-emitting element included in the pixels according to the sensing control signal and output a second sensing result;

a frequency detecting unit configured to count the vertical blank period to detect the variable frame frequency; and a selecting unit configured to compare the detected variable frame frequency with a reference value and selectively activate operations of the TFT compensating unit and the OLED compensation unit.

8. The organic light emitting display device of claim 7, wherein the driving characteristics of the light-emitting element indicate an operating point voltage of the light-emitting element.

9. The organic light emitting display device of claim 8, wherein the selecting unit activates an operation of the TFT compensating unit when the detected variable frame frequency is equal to or greater than the reference value and activates the operation of the OLED compensating unit when the detected variable frame frequency is less than the reference value.

10. The organic light emitting display device of claim 9, further comprising:

a data processing unit configured to modulate the image data based on the first sensing result or the second sensing result to compensate for change of the driving characteristics of the pixels.

11. The organic light emitting display device of claim 9, wherein a sense driving frequency according to the operations of the TFT compensating unit and the OLED compensating unit is set to be a same regardless of the length of the vertical blank period.

12. A method of driving an organic light emitting display device, comprising:

receiving image data input at a variable frame frequency, and fixing a vertical active period for applying the image data to pixels and varying a vertical blank period in which no image data is applied to the pixels among one variable frame period which varies according to the variable frame frequency;

generating a sensing control signal for sensing the pixels in the vertical blank period varying according to the variable frame frequency; and sensing driving characteristics of a driving element included in the pixels according to the sensing control signal to output a first sensing result.

13. The method of claim 12, wherein the driving characteristics of the driving element include at least one of a threshold voltage and electron mobility of the driving element.

14. The method of claim 12, wherein the vertical active period is fixed based on a fastest frame frequency within a predetermine range of the variable frame frequency.

15. The method of claim 14, wherein the image data is synchronized with a pixel clock fixed based on the fastest frame frequency.

16. The method of claim 12, wherein the vertical blank period is recognized based on a vertical synchronization signal toggling at intervals of one variable frame period and a data enable signal for informing presence of the image data.

17. The method of claim 16, wherein a length of the vertical blank period varies in inverse proportion to a speed of the variable frame frequency, and a number of sensing times per frame increases as the length of the vertical blank period becomes longer.

18. The method of claim 17, further comprising:

sensing the driving characteristics of a light-emitting element included in the pixels according to the sensing control signal and outputting a second sensing result;

counting the vertical blank period to detect the variable frame frequency; and comparing the detected variable frame frequency with a reference value.

19. The method of claim 18, wherein the driving characteristics of the light-emitting element indicate an operating point voltage of the light-emitting element.

20. The method of claim 19, wherein the driving characteristics of the driving element are sensed when the detected variable frame frequency is equal to or greater than the reference value and the driving characteristics of the light-emitting element are sensed when the detected variable frame frequency is less than the reference value.

21. The method of claim 20, further comprising:

modulating the image data based on the first sensing result or the second sensing result to compensate for change of the driving characteristics of the pixels.

22. The method of claim 20, wherein a sense driving frequency is set to be a same regardless of the length of the vertical blank period.

* * * * *